US011069176B2

(12) United States Patent
Sumi et al.

(10) Patent No.: US 11,069,176 B2
(45) Date of Patent: Jul. 20, 2021

(54) GAME MACHINE PUSHBUTTON, ILLUMINATION DEVICE

(71) Applicant: Omron Corporation, Kyoto (JP)

(72) Inventors: Masaaki Sumi, Gifu (JP); Hiroyuki Onitsuka, Kani (JP); Jun Kishimoto, Ogaki (JP)

(73) Assignee: Omron Corporation, Kyoto (JP)

( * ) Notice: Subject to any disclaimer, the term of this patent is extended or adjusted under 35 U.S.C. 154(b) by 0 days.

(21) Appl. No.: 16/799,197

(22) Filed: Feb. 24, 2020

(65) Prior Publication Data

US 2020/0294348 A1 Sep. 17, 2020

(30) Foreign Application Priority Data

Mar. 14, 2019 (JP) ..... JP2019-047219

(51) Int. Cl.
*G07F 17/32* (2006.01)

(52) U.S. Cl.
CPC ..... *G07F 17/3209* (2013.01)

(58) Field of Classification Search
None
See application file for complete search history.

(56) References Cited

U.S. PATENT DOCUMENTS

| | | | | |
|---|---|---|---|---|
| 8,899,766 | B2 * | 12/2014 | Ikeuchi | H01H 13/023 362/23.05 |
| 9,542,795 | B2 * | 1/2017 | Okazaki | G07F 17/3209 |
| 9,875,599 | B2 * | 1/2018 | Onitsuka | G07F 17/34 |
| 10,232,248 | B2 * | 3/2019 | Sakamoto | A63F 13/24 |
| 10,279,246 | B2 * | 5/2019 | Sakamoto | A63F 7/022 |
| 10,783,739 | B2 * | 9/2020 | Sumi | G07F 17/3209 |
| 10,957,499 | B2 * | 3/2021 | Sumi | G07F 17/3209 |

FOREIGN PATENT DOCUMENTS

JP 2007-317380 A 12/2007

* cited by examiner

*Primary Examiner* — Jay Trent Liddle
*Assistant Examiner* — Alex P. Rada, II
(74) *Attorney, Agent, or Firm* — Osha Bergman Watanabe & Burton LLP

(57) ABSTRACT

A game machine pushbutton configured for mounting to a game machine, the game machine pushbutton including: an input key configured to accept a depression thereof; a plurality of light sources arranged along a peripheral part of the input key; and a light guide including a lighting surface; the light guide provided to surround the peripheral part of the input key and configured to direct light radiating thereon from the plurality of light sources and emit the light from the lighting surface; and the plurality of light sources is arranged with light emitting surfaces thereof oriented in a direction that is different from the direction toward which the lighting surface is oriented.

14 Claims, 14 Drawing Sheets

GAME MACHINE PUSHBUTTON, ILLUMINATION DEVICE

CROSS-REFERENCES TO RELATED APPLICATIONS

This application claims the benefit of Japanese Patent Application No. 2019-047219 filed on Mar. 14, 2019.

FIELD

The present invention relates generally to a game machine pushbutton and an illumination device, and more specifically to ways of eliminating light spots on a lighting surface.

BACKGROUND

A player selects and plays a game machine of their preference at a gaming facility such as a casino. Casinos house multiple game machines, e.g., slot machines, produced by a variety of manufacturers. For that reason, a game machine must have some kind of appeal to attract a player and cause the player to want to play on the game machine.

An input portion is provided on the game machine at a conspicuous location on the front surface (facade) presented to the player; the player directly manipulates the input portion. Therefore, the input portion is an important part of the game machine for appealing to a player; the game machine pushbutton, which is arranged on the input portion, is another important component for appealing to a player.

As an example, in Japanese Patent Publication No. 2007-317380 the pushbutton mounted on the slot machine emits light to attract a player to the slot machine. In the technology disclosed in JP 2007-317380 A, an input surface is illuminated via light emitted from a light source (light emitting element) via a diffusion sheet causing the aforementioned input surface (lighting surface) to emit light.

Technical Problem

The diffusion sheet is arranged some distance from the light source in the operation switch disclosed in JP 2007-317380 A; the light emitted from the light source diffuses naturally and then diffuses further due to the diffusion sheet. With sufficient distance between the light source and the diffusion sheet this configuration is capable of preventing the appearance of a light spot. A "light spot" is a phenomenon where the portion containing the light source appears brighter than other portions.

However, in this case, naturally this creates a longer distance between the light source and the lighting surface, and, if the lighting surface also serves as the input surface, this increases the thickness of the pushbutton, making it difficult to reduce the profile of the button. Additionally, this configuration is suitable when the desire is to illuminate the entire input surface; however, if the desire is for only the side or the periphery to serve as a lighting surface, only a small proportion of the light emitted from the light source is perceived by the player making it difficult to use the light from the light source effectively.

An embodiment of the present invention aims to achieve a game machine pushbutton and an illumination device that are thin, capable of providing effective use of light, and further allow a lighting surface to emit light without creating a light spot.

Solution to Problem

To address the forgoing, a game machine pushbutton according to an embodiment of the present invention is configured for mounting to a game machine; the game machine pushbutton includes: an input key configured to accept a depression thereof; a plurality of light sources arranged along a peripheral part of the input key; and a light guide including a lighting surface, the light guide provided to surround the peripheral part of the input key and configured to direct light radiating thereon from the plurality of light sources and emit the light from the lighting surface; and the plurality of light sources is arranged with light emitting surfaces thereof oriented in a direction that is different from the direction toward which the lighting surface is oriented.

The plurality of light sources is arranged with each of the light emitting surfaces of the light sources oriented in a direction that is different from the direction toward which the lighting surface is oriented in the above configuration. Therefore, the above configuration makes it possible to prevent a light spot whereat the portion containing a light source appears brighter without the light emitting surfaces being seen via the lighting surface. Light from the light source may be used effectively since a light guide is used to guide light from the light source and emit the light from the lighting surface; further, a thinner device is possible compared to a configuration that uses natural diffusion or combines natural diffusion with use of a diffusion sheet since there is no need to secure a long path for diffusion.

The plurality of light sources in a game machine pushbutton according to another embodiment is arranged with the light emitting surfaces thereof oriented in the press direction of the input key. This configuration facilitates arranging the plurality of light sources with each of the light emitting surfaces of the light sources oriented in a direction that is different from the direction toward which the lighting surface is oriented. Given that when looking at the pushbutton a player assumes the direction of their gaze is the direction for pushing the input key, placing the plurality of light sources in such an orientation can reliably prevent the appearance of a light spot.

A game machine pushbutton according an embodiment may further include a reflective component for returning light exiting from the light guide into the light guide, the reflective component arranged at the reverse surface of the light guide which is opposite the surface where light from the light sources enters the light guide. The reflective component returns light leaking from the rear side of the light guide inward; therefore, the above configuration reduces the loss due to light leakage and allows for even more effective use of light.

In the game machine pushbutton according to an embodiment of the present invention, the reflective component may include a diffusion function that diffuses the light exiting from the light guide and returns the light to inside the light guide. The reflective component returns light leaking from the rear side of the light guide inward; therefore, the above configuration allows for light propagate inside the light guide at a variety of angles, allowing for light to propagate effectively to portions of the light guide situated away from the light sources. Consequently, this suppresses the creation of a dark spot, which appears on the lighting surface because of a portion of the lighting surface that light from a light source tends not to reach; this portion appears darker than other portions of the lighting surface.

In a game machine pushbutton according to an embodiment of the present invention, the reflective component includes a diffusion function that diffuses the light emitted from the light guide and returns the light to inside the light guide. The reflective structure reflects a portion of the light radiating thereon from a light source in a direction where another adjacent light source is located; therefore, the above configuration suppresses the creation of a dark spot which appears on the lighting surface because of a portion of the lighting surface that light from a light source tends not to reach; this portion appears darker than other portions of the lighting surface; the above configuration achieves more even lighting of the lighting surface.

In a game machine pushbutton according to an embodiment of the present invention, the reflective structure is a V-shaped groove provided in the reverse surface of the light guide at locations where light is incident from the light sources. The above configuration facilitates obtaining a reflective structure.

An illumination device according to an embodiment of the present invention includes a plurality of light sources; and a light guide including a lighting surface; the light guide directing light radiating thereon from the plurality of light sources and emitting the light from the lighting surface; and the plurality of light sources arranged with the light emitting surfaces thereof oriented in a direction different from the direction toward which the lighting surface is oriented.

The plurality of light sources is arranged with each of the light emitting surfaces of the light sources oriented in a direction that is different from the direction toward which the lighting surface is oriented in the above configuration. Therefore, the above configuration makes it possible to prevent a light spot whereat the portion containing a light source appears brighter without the light emitting surfaces being seen via the lighting surface. Light from the light source may be used effectively since a light guide is used to guide light from the light source and emit the light from the lighting surface; further, a thinner device is possible compared to a configuration that uses natural diffusion or combines natural diffusion with use of a diffusion sheet since there is no need to secure a long path for diffusion.

Effects

An embodiment of the present invention achieves a game machine pushbutton and an illumination device that are thin, capable of providing effective use of light, and further allow a lighting surface to emit light without creating a light spot.

DETAILED DESCRIPTION

First Embodiment

An embodiment (below, "the embodiment") according to an aspect of the present invention is described below on the basis of the drawings. This embodiment illustrates an example of a pushbutton for a game machine, for instance, a pushbutton that may be mounted on a slot machine, as a type of pushbutton for a game machine according to the present invention.

1. Example Application

Figure 1A:
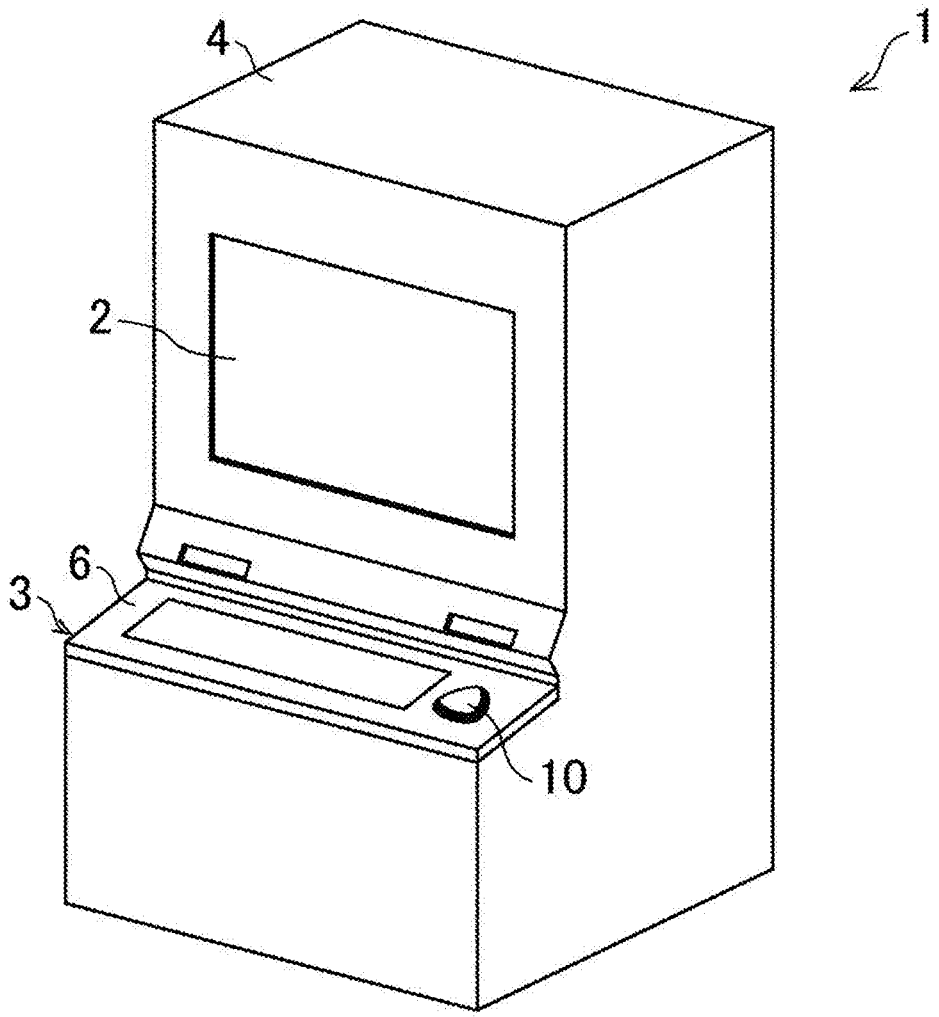
FIG. 1A is a perspective view of a slot machine with a pushbutton according to a first embodiment of the present invention mounted thereon.

A situation where a game machine pushbutton 10 (below, pushbutton 10) may be adopted is described with reference to FIGS. 1A, 1B, FIGS. 2A, 2B, and 2C, FIG. 5, and FIG. 6. FIG. 1A is a perspective view of a slot machine 1 with a pushbutton 10 according mounted thereon; and FIG. 1B is a top view of the slot machine 1.

Figure 1B:
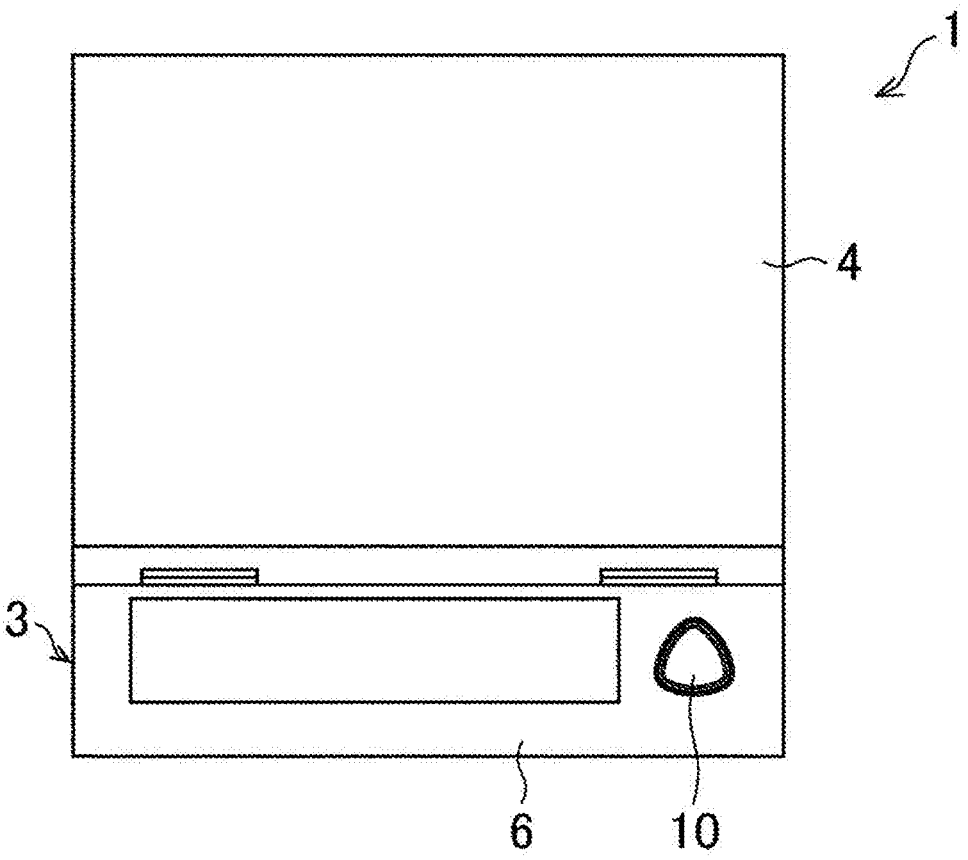
FIG. 1B is a top view of the slot machine.

As illustrated in FIGS. 1A and 1B, the slot machine 1, which serves as the game machine is provided with a display monitor 2 at a location on the upper part of the enclosure 4 of the game machine where a player would look; an input unit 3 is provided at the lower front of the enclosure 4 (near the player) below the display monitor 2.

The input unit 3 is provided on the top surface of a protruding portion that juts frontward from the lower part of the enclosure 4; a display device such as an LCD (not shown) is arranged on the input unit 3. The pushbutton 10 overlaps the display screen of the display device 10 and allows viewing of the content on the display screen of the display device 10 through an input key 12 thereon.

Figure 2A:
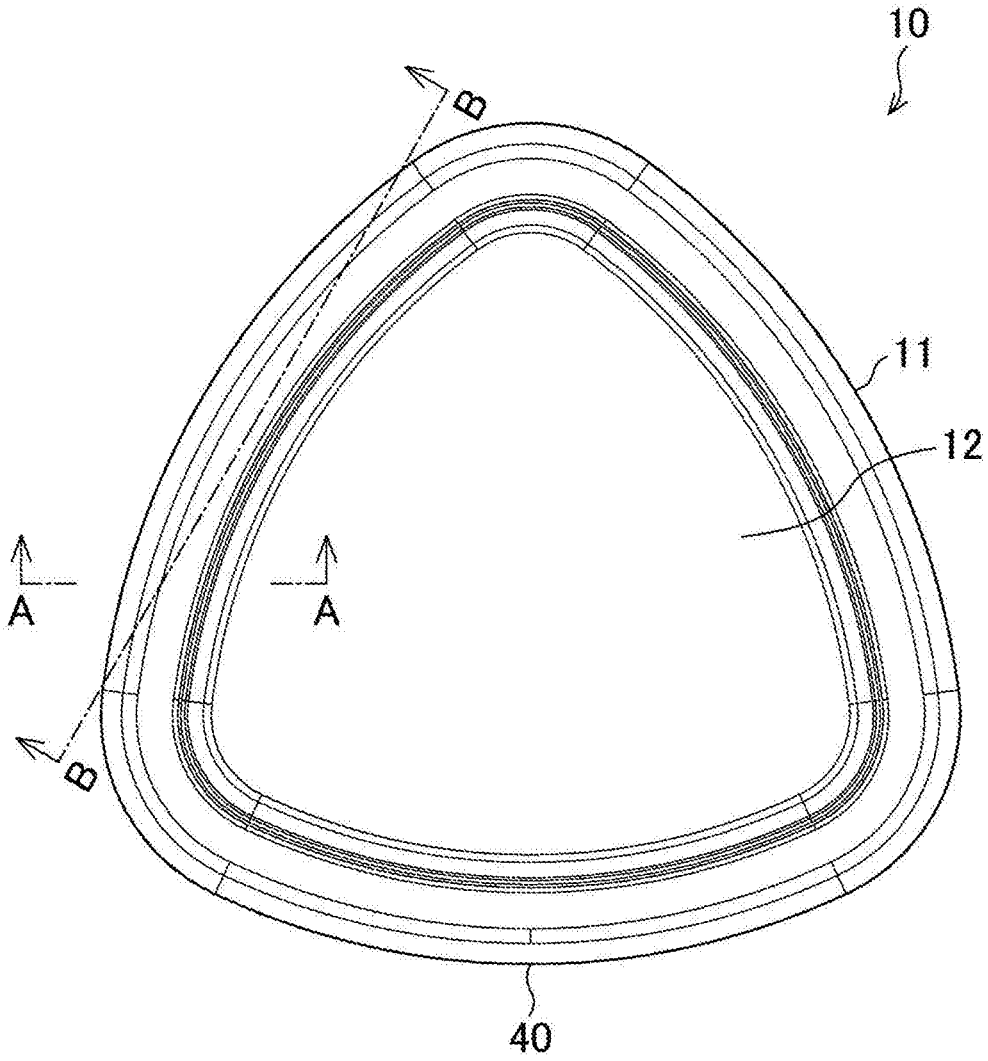
FIG. 2A is a plan view of the pushbutton.
Figure 2B:
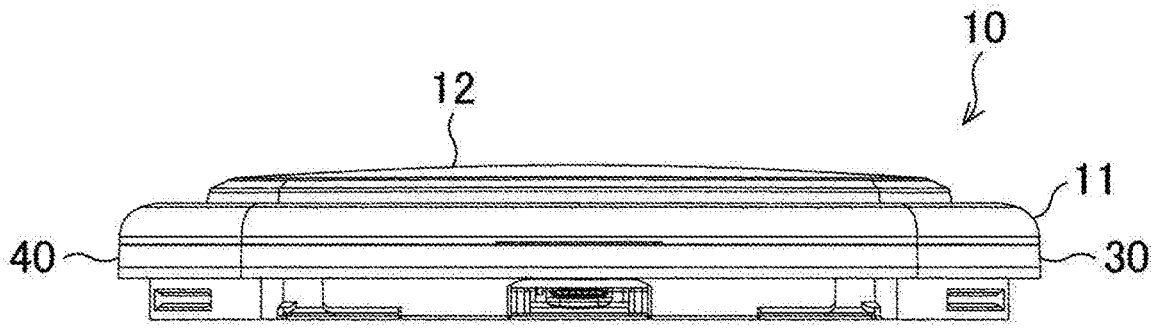
FIG. 2B is a front view.
Figure 2C:
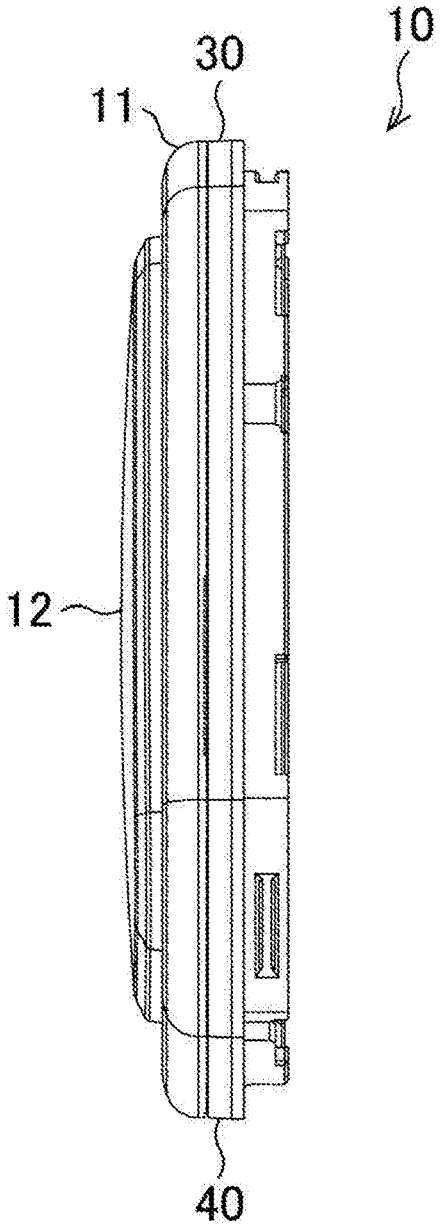
FIG. 2C is a side view.

As illustrated in FIGS. 2A through 2C, the pushbutton 10 includes a base 30, a bezel 11, and the input key 12 supported via these elements to allow the input key 12 to be pressed. The base 30 includes a light guide component 31 (light guide) made up of a light guide element with the periphery (peripheral surface 31*a*) of the light guide component 31 serving as a lighting surface 40 that emits light.

Figure 5:
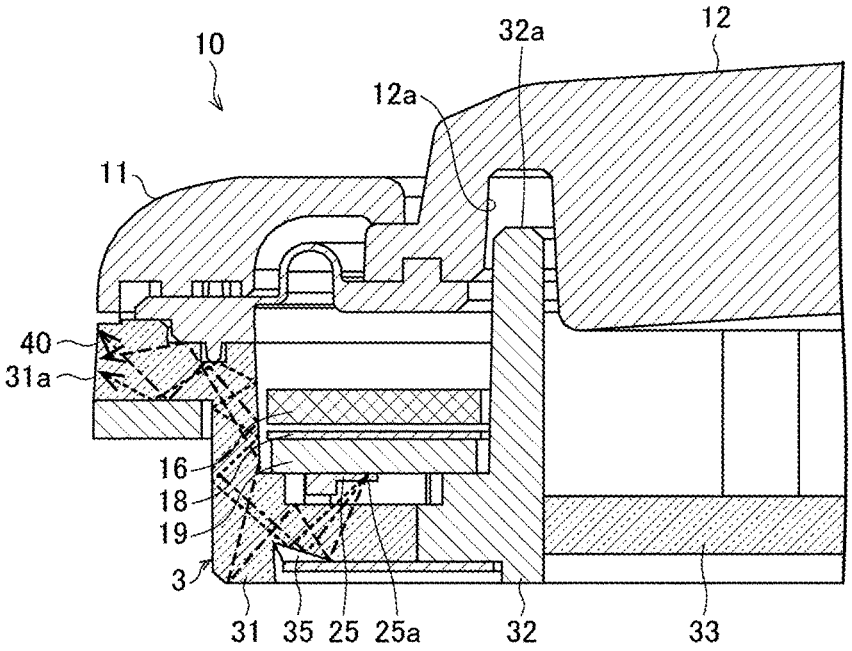
FIG. 5 is a diagram for describing the light guide path in the pushbutton.
Figure 6:
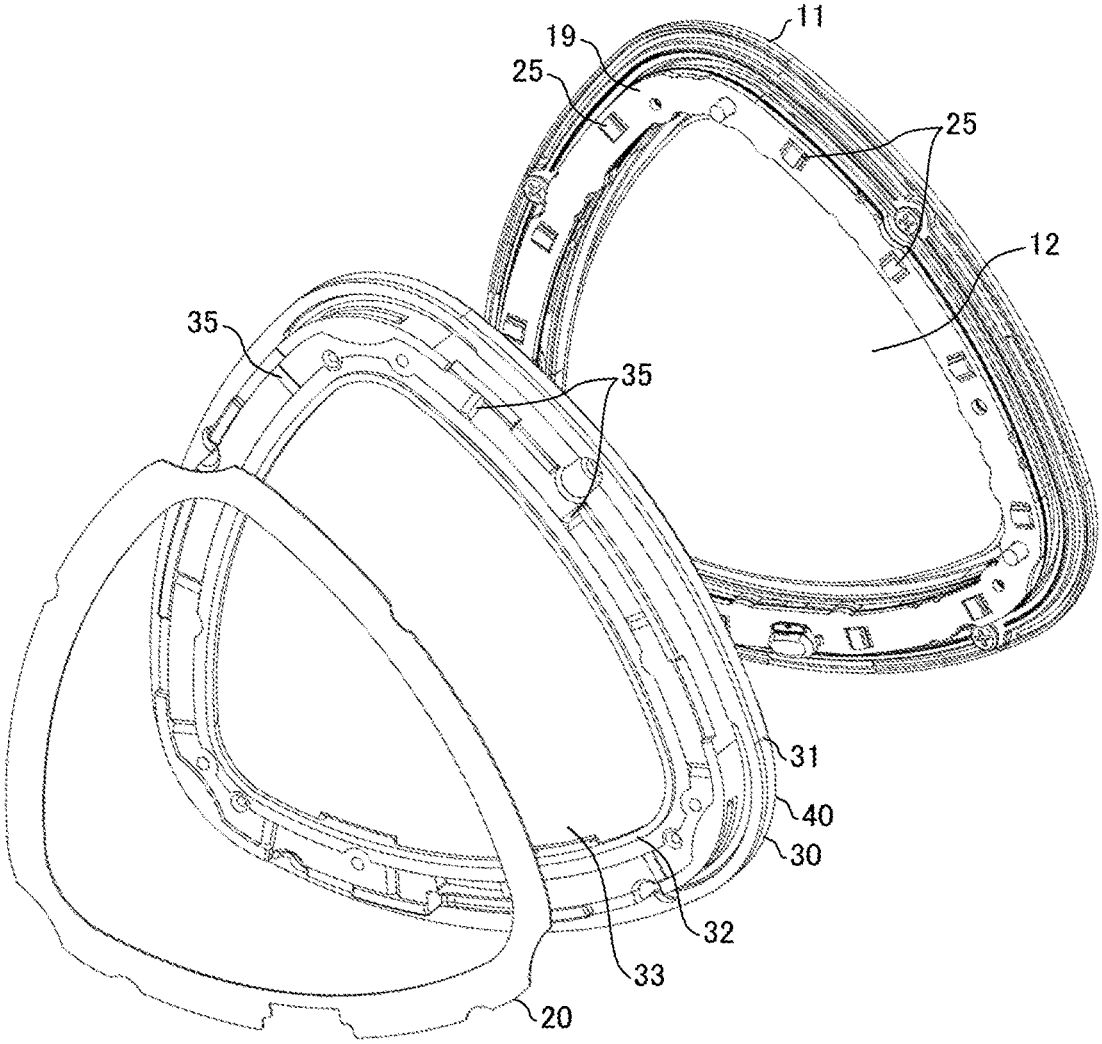
FIG. 6 is an exploded perspective view of the pushbutton and separately illustrates an intermediate part where bezel through LED substrate are assembled; a base; and a reflection sheet.

As illustrated in FIG. 6, a plurality of LEDs 25, which serves as a light source, is placed on the periphery of the input key 12 for supplying the light guide component 31 with light. The plurality of LEDs 25 is arranged with the light emitting surfaces 25 of LEDs 25 oriented in a direction that is different from the direction toward which the lighting surface 40 is oriented. In the example illustrated in FIG. 5, the light emitting surfaces 25*a* of the plurality of LEDs 25 are oriented toward the press direction of the input key 12.

This configuration reliably prevents a light spot without the light emitting surfaces 25*a* being seen via the lighting surface 40. In addition, there is no need to secure a long optical path to allow diffusion as is the case when using natural diffusion; the configuration can be given a thin profile. Moreover, the light emitted from the LEDs 25 may be used effectively because the structure is configured so that the light guide component 31 propagates light and the lighting surface 40 extracts the light propagated by the light guide component 31. Hereby, a thin pushbutton may be obtained that provides effective use of light from a light source, and further emits light without any light spots on the lighting surface. Given that when looking at the pushbutton a player assumes the direction of their gaze is the direction for pushing the input key, orienting the light emitting surfaces 25*a* toward the press direction in particular reliably prevents light spots.

2. Example Configuration

Configuration of Pushbutton 10

An overview of the configuration of a pushbutton 10 according to an aspect of the present invention is described. FIG. 2A is a plan view, FIG. 2B is a front view, and FIG. 2C is a side view of the pushbutton 10. As illustrated in FIGS. 2A through 2C, the pushbutton 10 is a thin device that appears substantially triangular in a plan view.

The pushbutton 10 includes a bezel 11, a base 30, and an input key 12 supported by these elements to allow the input key 12 to be pressed. The pushbutton 10 is designed to a thickness (the dimension in the press direction) of roughly 14 mm, for example. Note that the planar shape of the pushbutton according to the present invention is not limited to being roughly triangular. In addition, the present embodiment is described with the assumption that the pushbutton 10 is arranged on a horizontal surface with a downward press direction and an upward return direction.

Figure 3:
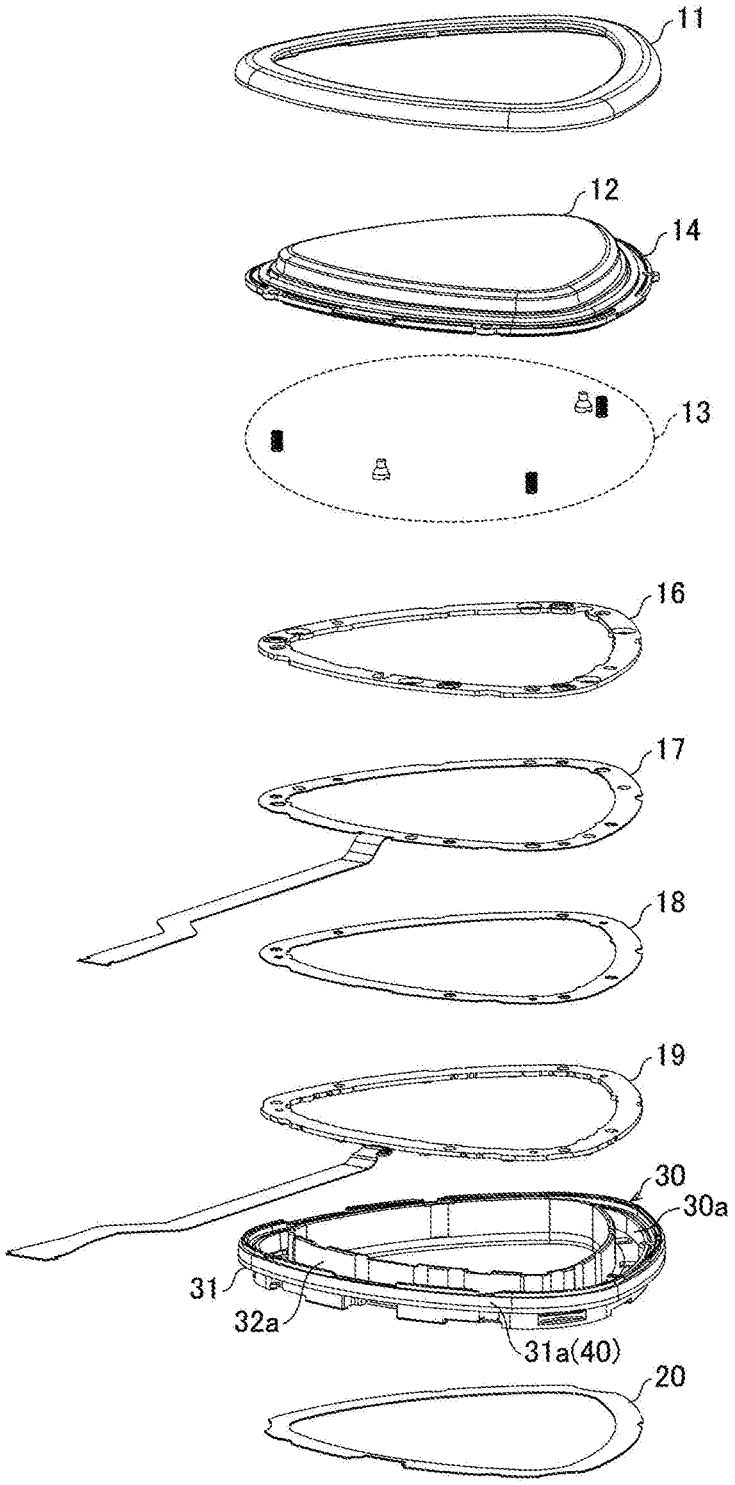
FIG. 3 is an exploded perspective view of the pushbutton.
Figure 4:
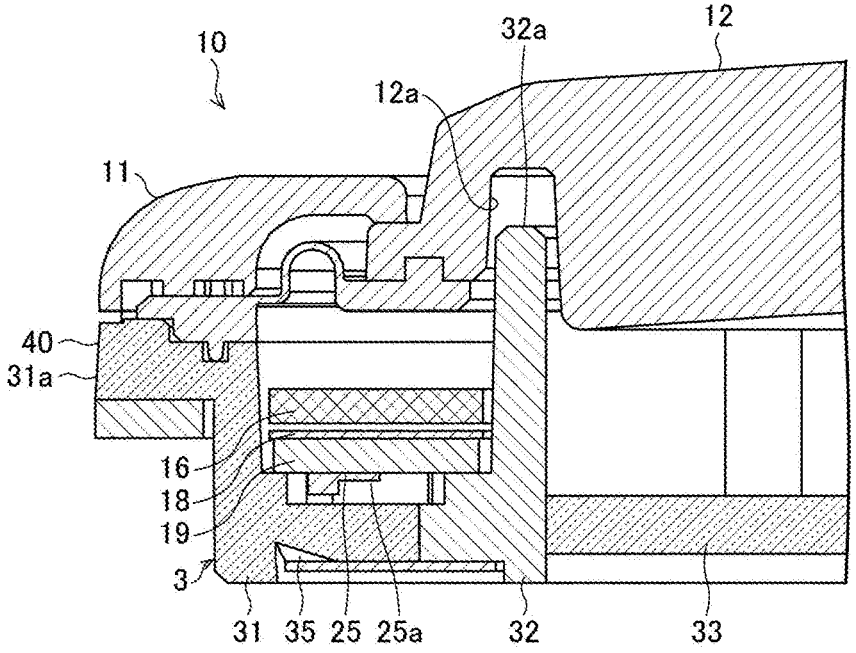
FIG. 4 is a cross-sectional view along the arrow A-A in FIG. 2A.

FIG. 3 is an exploded perspective view of the pushbutton 10; FIG. 4 is a cross-sectional view along the arrow A-A in FIG. 2A; and as illustrated in FIG. 3 and FIG. 4, in addition to above described bezel 11, base 30, and input key 12, the pushbutton 10 includes a structural component 13, a plate 16, a pressure sensor substrate 17, a spacer 18, an LED substrate 19, and a reflective sheet 20.

The bezel 11 is a cover component for covering and protecting a portion of the top surface and the side surface of the pushbutton 10. The bezel 11 is provided around the peripheral part of the input key 12 and includes an opening 11*a* that allows the center portion of the input key 12 to travel in the press direction.

The input key 12 is the component that receives the pressing operation and is formed from a transparent material and with a thick center portion. A channel 12*a* is formed on the reverse side of the input key 12 whereinto a guide wall 32*a* on the base 30 enters; the input key 12 travels vertically along the guide wall 32A. The bezel 11 limits the vertical movement of the input key 12.

The input key 12 is integrally provided with water-resistance packing 14 on the peripheral part thereof. The internals of the pushbutton 10 may be protected from the intrusion of liquids by securing the bezel 11 onto the base 30 using a screw or the like (not shown) with the water-resistance packing 14 sandwiched therebetween.

The structural component 13 contains a spring and a piece of rubber; the spring causes the depressed input key 12 to return, and the rubber supplies a click sensation when the input key 12 is pressed. The pressure sensor substrate 17 is provided with a pressure sensor (not shown) that detects the press of the input key 12; the pressure sensor substrate 17 is placed on the reverse side of the input key 12 with the plate 16 therebetween.

The LED substrate 19 is provided with a plurality of LEDs 25 that serves as a light source. The plurality of LEDs 25 is arranged with the light emitting surfaces 25*a* of LEDs 25 oriented in a direction that is different from the direction toward which the lighting surface 40 is oriented. In the present embodiment, the plurality of LEDs 25 is mounted on the reverse side of the LED substrate 19, that is, the surface facing the base 30; the plurality of LEDs 25 is arranged with the light emitting surfaces 25*a* oriented downward, i.e., in the press direction of the input key 12.

The base 30 supports the input key 12 and the bezel 11. The base 30 includes a storage chamber 30*a* at the peripheral part, with the storage chamber 30*a* housing the above-described structural component 13, plate 16, pressure sensor substrate 17, spacer 18, and LED substrate 19.

The base 30 is made up of three parts: the light guide component 31 at the peripheral part, a light shielding component 32 inward thereof, and a transparent component 33 at the center. The light guide component 31 is produced from a light guiding element; light emitted from the plurality of LEDs 25 is guided into the light guide component 31 which propagates the incident light therethrough and directs the light to a peripheral surface 31*a*. In this embodiment, the peripheral surface 31*a* of the light guide component 31 is the lighting surface 40 in the pushbutton 10. The lighting surface 40 is treated to provide a light diffusing function for extracting light from inside the light guide component 31 to be extracted to the outside (e.g., the lighting surface 40 may be treated to create fine recesses and protrusions thereon).

The light guide component 31 is also provided with a reflective structure 35 (later described) where the light enters therein from the LEDs 25. In the present embodiment, the reflective structure 35 is a V-shaped groove provided on the reverse surface of the light guide component 31 where the light enters therein from the LEDs 25.

The light shielding component 32 is produced from a light shielding element and blocks light leaking from the light guide component 31 toward the inner parts thereof. The above-described storage chamber 30*a* is provided to contain the boundary between the light guide component 31 and the light shielding component 32. A guide wall 32*a* is provided to the light shielding component 32; the guide wall 32*a* defines the vertical movement of the input key 12 when the input key 12 is pressed and when the input key 12 returns. The transparent component 33 is produced from a transparent element and allows the display screen of the display device situated below the pushbutton 10 to be seen.

The reflective sheet 20 (reflective component) returns light leaking from the light guide component 31 toward the inside the light guide component 31. The reflective sheet 20 is preferably an element capable of diffusing the light leaking from the light guide component 31 and returning that light thereto, e.g., an opal sheet.

Light Guide Path and Structure for Preventing a Light Spot

A light guide path and a structure for preventing a light spot is described using FIG. 5. FIG. 5 is a diagram for describing the light guide path in the pushbutton 10; as illustrated in FIG. 5, the LEDs 25 are mounted on the reverse surface of the LED substrate 19 with the light emitting surfaces 25*a* oriented downward, which is the press direction of the input key 12. The light-emitting surfaces 25*a* are placed adjacent to the light guide component 31 and the light emitted from an LED 25 enters the light guide component 31 at the portion thereof arranged opposite the light emitting surface 25*a*.

The light guided to and then entering the light guide component 31 at an angle to the reverse surface totally reflects inside the light guide component 31 between the incident surface (the surface toward the LEDs 25) and the reverse surface and propagates therethrough with the light emitted externally on arriving at the peripheral surface 31*a* which is the lighting surface 40. The light shielding component 32 absorbs the light arriving thereat directly or via reflection. Light may thus be prevented from leaking toward inside the pushbutton 10.

Light guided to and then entering the light guide component 31 perpendicularly with no angle to the reverse surface is diffused and returned to inside the light guide component 31 by the reflective sheet 20. Light may be used more effectively when the light exiting from the light guide component 31 is returned to inside the light guide component 31. The diffusion of light increases the angles of light permitted relative to the reverse surface of the light guide component 31; the light propagates through the light guide component 31 while totally reflecting between the incidence surface and the reverse surface and arrives at the lighting surface 40 and is emitted therefrom. That is, the diffusion of light allows for light of various angles to propagate within the light guide component 31 and allows for light to effectively propagate to portions away from the LEDs 25. This prevents the occurrence of dark spots on the lighting surface 40 which appear darker than other portions of the lighting surface 40 because of where light from the LEDs 25 tend not to reach. Note that FIG. 5 depicts and is used to describe the light guide path of only the light entering the light guide component 31 from the LED 25 at an angle; descriptions of the light guide path for light entering at an angle due to diffusion by the reflective sheet 20 and the light guide path for light oriented toward the light shielding component 32 are omitted.

In this embodiment the light emitted from the plurality of LEDs 25 is thus taken into the light guide component 31 from the incidence surface, propagated through inside the light guide component 31 and directed to the lighting surface 40 in a highly efficient manner. The light emitted from a light source may thus be used effectively.

The plurality of LEDs 25 in the embodiment is arranged with each of the light emitting surfaces 25*a* oriented in a direction that is different from the direction toward which the lighting surface 40 is oriented in this embodiment; therefore, it is possible to reliably prevent a light spot without the LEDs 25 being seen via the lighting surface 40.

Structure for Preventing the Occurrence of a Dark Spot

Figure 7:
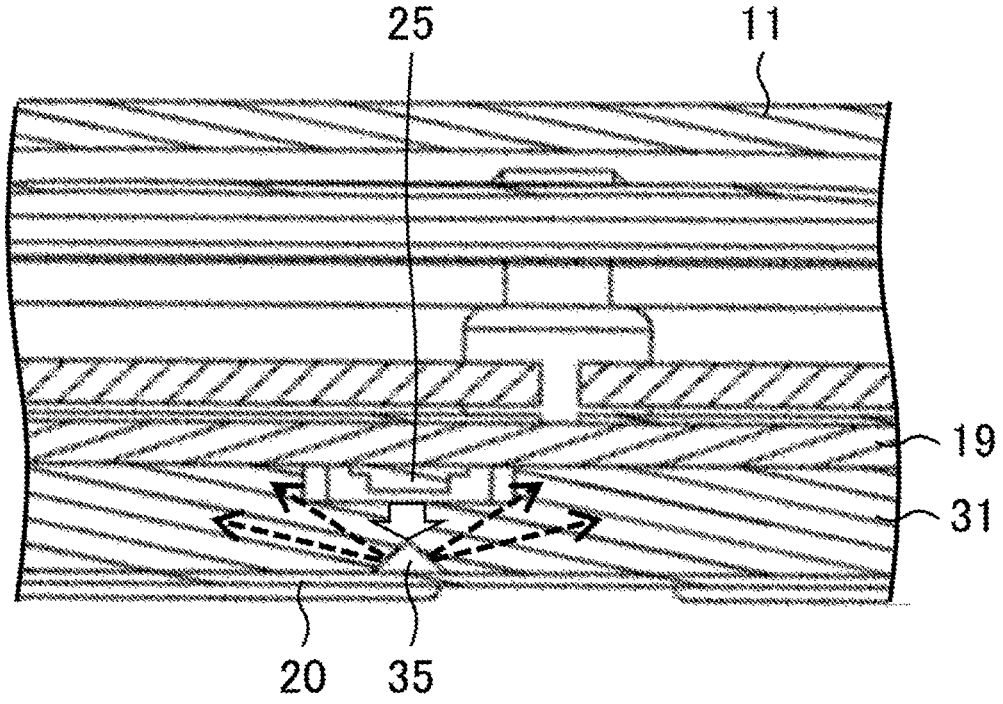
FIG. 7 is a cross-sectional view along the arrow B-B and illustrates the path of light in the section provided with the reflective structure.

Next, a structure for prevent the occurrence of a dark spot is described using FIG. 6 and FIG. 7. The term "dark spot" refers to a portion of the lighting surface that appears darker than other portions because light from an LED 25 tends not to reach that portion. FIG. 6 is an exploded perspective view of the pushbutton 10 and separately illustrates an intermediate part where the bezel 11 through LED substrate 19 are assembled; the base 30; and the reflective sheet 20; FIG. 7 is a cross-sectional view along the arrow B-B in FIG. 2A and illustrates the path of light in the section provided with the reflective structure 35.

As illustrated in FIG. 6 and FIG. 7, the reflective structure 35 is provided in the light guide component 31 of the base 30 at locations where the light is incident from the LEDs mounted on the LED substrate 19. The reflective structure 35 reflects a portion of the light radiating from an LED 25 toward different adjacent LEDs 25. In the present embodiment, the reflective structure 35 is a V-shaped groove provided on the reverse surface of the light guide component 31 where the light enters therein from the LEDs 25.

As illustrated in FIG. 7, with the reflective structure 35 present, light radiating downward from an LED 25 strikes the reflective structure 35 at an angle; therefore, even light with no angle, such as light that would in theory escape straight from the reverse surface of the light guide tends not to travel out from the reverse surface. Hereby, even if no reflective sheet 20 present, in principle, it is possible to prevent light from escaping from the reverse surface and to use light from the LED 25 effectively.

Because this kind of reflective structure 35 reflects a portion of the light radiating from an LED 25 toward different adjacent LEDs 25, light may be dispatched to portions between the LEDs 25 where light tends not to reach. Hereby, it is possible to effectively reduce the occurrence of dark spots which are portions that appear darker because the light from an LED 25 tends not to reach and illuminate the lighting surface evenly.

Effects

As stated, the above-mentioned configuration reliably prevents a light spot by arranging the plurality of LEDs 25 with each of the light emitting surfaces 25*a* oriented in a direction that is different from the direction toward which the lighting surface 40 is oriented. The configuration also uses light effectively by using the light guide component 31 to direct light to the lighting surface 40. Moreover, the configuration uses the reflective sheet 20 to prevent light from leaking from the light guide component 31 and uses the reflective structure 35 to reduce the occurrence of dark spots. The dark spots are effectively reduced through the action of the reflective sheet 20 and the reflective structure 35 with the reflective sheet 20 arranged over the entire reverse side of the light guide component 31 and having a light diffusing function.

The configuration may be made thin and provide effective use of light from the LEDs 25, and, further causes the lighting surface 40 to emit light evenly with no light spot or dark spot.

Second Embodiment

Another embodiment of the present invention is described below. For the sake of convenience, components previously described in the above embodiment that have an identical function are given the same reference numerals, and explanations therefor are not repeated.

The configuration in the first embodiment is applied to a pushbutton 10 for a game machine allowing for a thin device and for effective use of light, and allow the lighting surface to emit light without any light spots. However, this configuration may also be applied to an illumination device.

Figure 8:
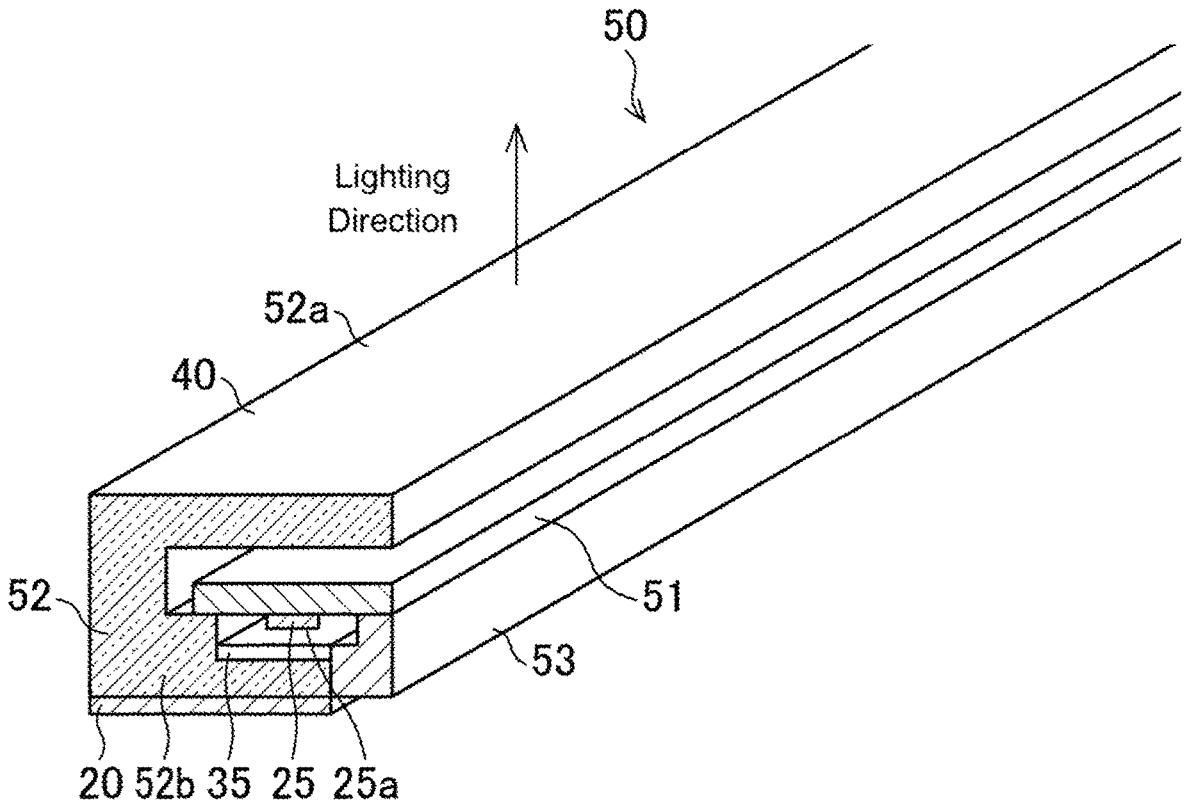
FIG. 8 is a partial cross-sectional view illustrating a basic structure of an illumination device according to a second embodiment of the present invention.

FIG. 8 is a partial cross-sectional view illustrating a basic structure of an illumination device 50 according to a second embodiment of the present invention; as illustrated in FIG. 8, the illumination device 50 is provided with an LED substrate 51 whereon a plurality of LEDs 25 is mounted, a light guide component 52, a light shielding component 53, and a reflective sheet 20. The LED substrate 51 is oblong with at least one row of a plurality of LEDs 25 aligned along the length thereof. The light guide component 52 is C-shaped in cross section and encloses the LED substrate 51, with one of the opposing walls 52*a* of the C-shape serving as the lighting surface 40.

The plurality of LEDs 25 is arranged with the light emitting surfaces 25*a* of LEDs 25 oriented in a direction that is different from the direction toward which the lighting surface 40 is oriented; more specifically, the light emitting surfaces 25*a* are oriented toward the other opposing wall 52*b* of the C-shape. A reflective structure 35 is provided at the locations on the other wall 52*b* where light from an LED 25 enters the other wall. A light shielding component 54 is also provided at the end part of the other wall 52*b* with a reflective sheet 20 on the reverse surface of the other wall 52*b*.

This kind of structure allows the light emitted from the plurality of LEDs 25 to thus be taken into the light guide component 52 from the other wall 52*b* in a highly efficient manner; the light propagates inside the light guide component 52 while being guided toward and then emitted from the lighting surface 40. The plurality of LEDs 25 in the embodiment is arranged with each of the light emitting surfaces 25*a* oriented in a direction that is different from the direction toward which the lighting surface 40 is oriented in this case as well; therefore, it is possible to reliably prevent a light spot without the LEDs 25 being seen via the lighting surface 40.

The reflective sheet 20 prevents light from leaking and diffuses the light, and the reflective structure 35 dispatches light to portions between the LEDs 25 where there is no LED 25 to thus effectively reduce the occurrence of dark spots.

Hereby, an illumination device 50 may be obtained that is thin and is capable of providing effective use of light from the LEDs 25, and, further of causing the lighting surface 40 to emit light evenly with no light spot or dark spot.

Figure 9A:
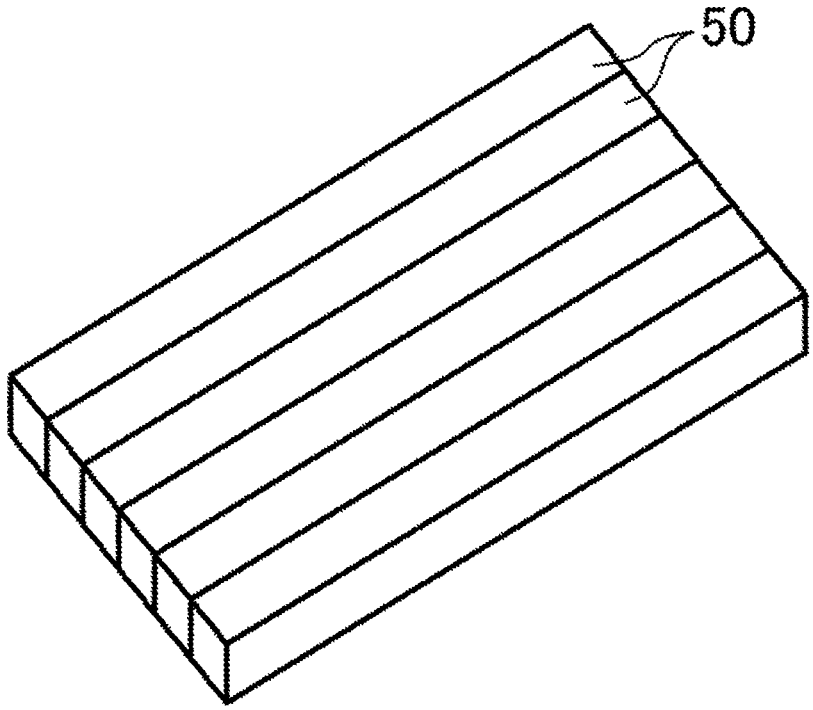
FIGS. 9A and 9B are perspective views schematically illustrating a possible modification to the lighting device making use of the lighting device 50.
Figure 9B:
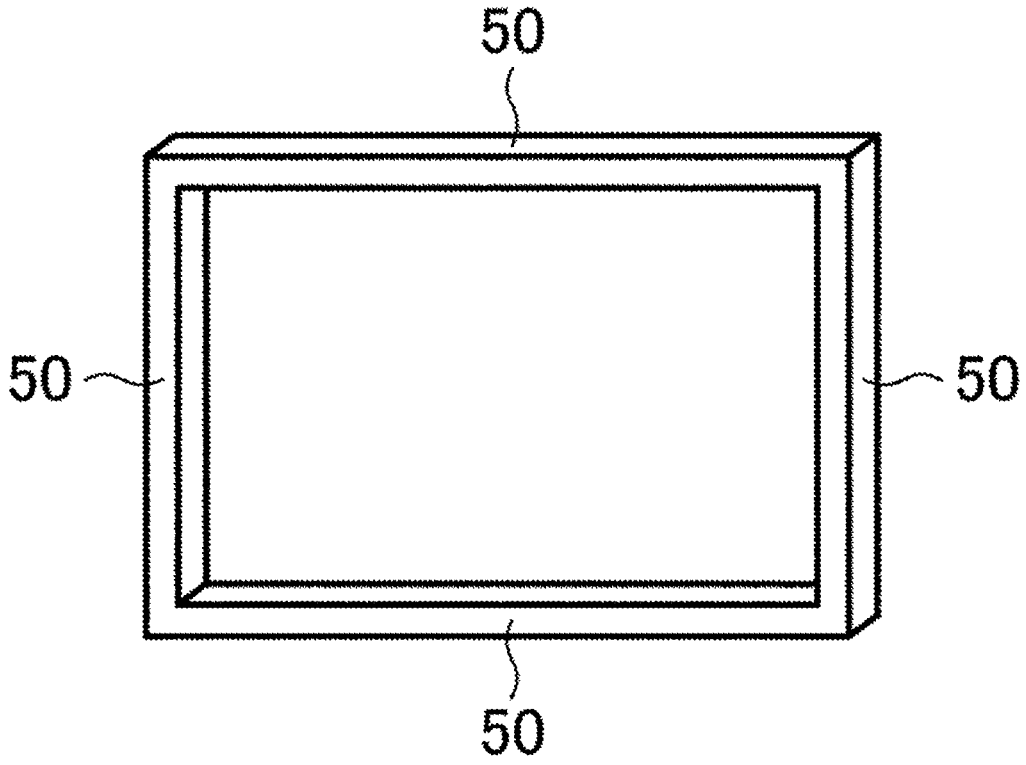

FIGS. 9A and 9B are perspective views schematically illustrating a possible modification to the lighting device making use of the lighting device 50; as illustrated in FIG. 9A, without being limited to a line-shaped illumination device, an illumination device of a desired shape may be obtained, e.g., a rectangle or square, by aligning a plurality of the illumination devices 50; as illustrated in FIG. 9B, a frame illumination device may be obtained by arranging a plurality of the illumination devices 50 in a frame shape.

Figure 10:
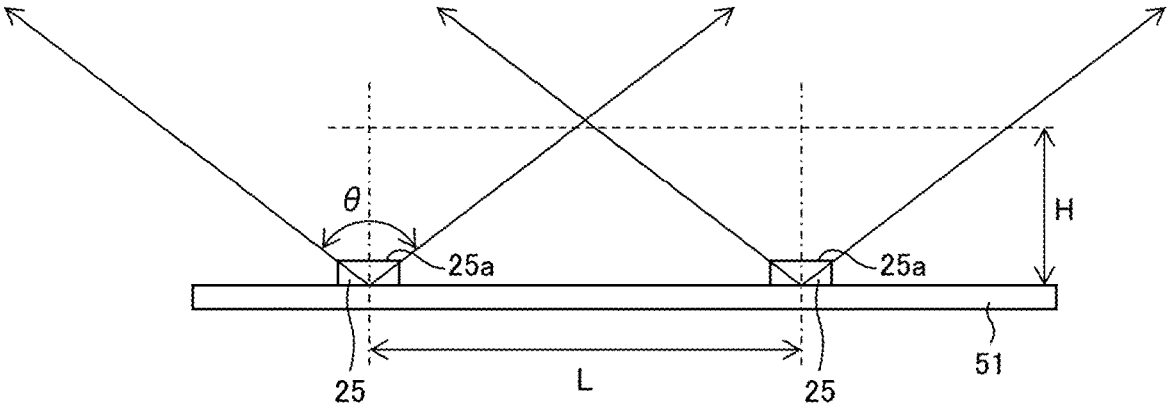
FIG. 10 is for describing theoretical values for light diffusion.

The thickness (dimension in the thickness direction) of the illumination device is described using FIG. 10. FIG. 10 is for describing theoretical values for light diffusion. As illustrated in FIG. 10, assume a separation distance between two adjacent LEDs 25 is L, the distance at which light from two adjacent LEDs 25 intersect is H, and the diffusion angle between two LEDs 25 is θ. This kind of relationship establishes $\tan(\theta/2)=(L/2)/H$, and $H=0.5\ L/\tan(\theta/2)$. The distance H is theoretically the distance at which a dark spot disappears. In other words, arranging a diffusion sheet at the distance H can obtain a lighting surface that has no dark spot.

However, the diffusion sheet must actually be placed further away than the distance H since the LED 25 emits the most intense light along the normal to the light emitting surface 25*a* and the light is weaker at the outer parts where there is an angle to the normal. Moreover, the diffusion sheet must be placed even further away to ensure the portion containing the LED 25 cannot be seen even with the placement of a diffusion sheet.

If the diffusion angle θ of the LEDs 25 is 100° and the separation distance L is 15 mm to 20 mm, for example, the distance H is 6.29 mm to 8.39 mm. That is, the diffusion sheet must be place at least 6.29 mm to 8.39 mm away from the LEDs 25, and must be place even further away to prevent a light spot. Therefore, this increases the thickness of an illumination device with a configuration that uses natural diffusion and a diffusion sheet.

In contrast, the illumination device 50 may be kept thin given there is no need to guarantee the distance H in a configuration where the LEDs 25 are arranged where the LEDs cannot be seen and a light guide component 52 directs light through to the lighting surface 40 to thus prevent a light spot. The illumination device may be made sufficiently thinner than the 6.29 to 8.39 mm required for a configuration using natural diffusion and a diffusion sheet when the diffusion angle θ and the separation distance L of the LEDs 25 have the same criteria by reducing the thickness (height) of the C-shaped light guide component 52 as much as possible while considering mechanical strength and light guiding function.

The invention claimed is:

1. A game machine pushbutton configured for mounting to a game machine, the game machine pushbutton comprising:

an input key configured to accept a depression thereof;

a plurality of light sources arranged along a peripheral part of the input key;

a light guide including a lighting surface; the light guide provided to surround the peripheral part of the input key and configured to direct light radiating thereon from the plurality of light sources and emit the light from the lighting surface; and the plurality of light sources is arranged with light emitting surfaces thereof oriented in a direction that is different from the direction toward which the lighting surface is oriented; and a reflective component for returning light exiting from the light guide into the light guide, the reflective component arranged at a reverse surface of the light guide which is opposite the surface where light from the light sources enters the light guide.

2. The game machine pushbutton according to claim 1, wherein the plurality of light sources is arranged with the light emitting surfaces thereof oriented in the press direction of the input key.

3. The game machine pushbutton according to claim 2, wherein the light guide includes a reflective structure at locations where light is incident from the light sources, and the reflective structure reflects a portion of the light radiating thereon from the light sources toward a different adjacent light source.

4. The game machine pushbutton according to claim 3, wherein the reflective structure is a V-shaped groove provided in the reverse surface of the light guide at locations where light is incident from the light sources.

5. The game machine pushbutton according to claim 1, wherein the reflective component includes a diffusion function that diffuses the light exiting from the light guide and returns the light to inside the light guide.

6. The game machine pushbutton according to claim 5, wherein the light guide includes a reflective structure at locations where light is incident from the light sources, and the reflective structure reflects a portion of the light radiating thereon from the light sources toward a different adjacent light source.

7. The game machine pushbutton according to claim 6, wherein the reflective structure is a V-shaped groove provided in the reverse surface of the light guide at locations where light is incident from the light sources.

8. The game machine pushbutton according to claim 1, wherein the light guide includes a reflective structure at locations where light is incident from the light sources, and the reflective structure reflects a portion of the light radiating thereon from the light sources toward a different adjacent light source.

9. The game machine pushbutton according to claim 8, wherein the reflective structure is a V-shaped groove provided in the reverse surface of the light guide at locations where light is incident from the light sources.

10. An illumination device comprising:

a plurality of light sources; and a light guide including a lighting surface and directing light radiating thereon from the plurality of light sources for the light to exit from the lighting surface;

the plurality of light sources arranged with the light emitting surfaces thereof oriented in a direction different from the direction toward which the lighting surface is oriented; and the light guide includes a reflective structure at locations where light is incident from the light sources, and the reflective structure reflects a portion of the light radiating thereon from the light sources toward a different adjacent light source.

11. A game machine pushbutton configured for mounting to a game machine, the game machine pushbutton comprising:

an input key configured to accept a depression thereof;

a plurality of light sources arranged along a peripheral part of the input key; and a light guide including a lighting surface; the light guide provided to surround the peripheral part of the input key and configured to direct light radiating thereon from the plurality of light sources and emit the light from the lighting surface;

the plurality of light sources is arranged with light emitting surfaces thereof oriented in a direction that is different from the direction toward which the lighting surface is oriented;

wherein the light guide includes a reflective structure at locations where light is incident from the light sources, and the reflective structure reflects a portion of the light radiating thereon from the light sources toward a different adjacent light source; and wherein the reflective structure is a V-shaped groove provided in the reverse surface of the light guide at locations where light is incident from the light sources.

12. The game machine pushbutton according to claim 11, wherein the plurality of light sources is arranged with the light emitting surfaces thereof oriented in the press direction of the input key.

13. The game machine pushbutton according to claim 11, further comprising: a reflective component for returning light exiting from the light guide into the light guide, the reflective component arranged at a reverse surface of the light guide which is opposite the surface where light from the light sources enters the light guide.

14. The game machine pushbutton according to claim 13, wherein the reflective component includes a diffusion function that diffuses the light exiting from the light guide and returns the light to inside the light guide.

* * * * *